US011015588B2

(12) United States Patent
Jang et al.

(10) Patent No.: US 11,015,588 B2
(45) Date of Patent: May 25, 2021

(54) COMPACT AIR COMPRESSOR

(71) Applicant: NEW MOTECH CO., LTD., Gwangju (KR)

(72) Inventors: Jeong Cheol Jang, Gwangju (KR); Jong Hyuk Kim, Gwangju (KR); Jin Sun Park, Gwangju (KR)

(73) Assignee: NEW MOTECH CO., LTD., Gwangju (KR)

( * ) Notice: Subject to any disclaimer, the term of this patent is extended or adjusted under 35 U.S.C. 154(b) by 54 days.

(21) Appl. No.: 16/491,155

(22) PCT Filed: Apr. 4, 2018

(86) PCT No.: PCT/KR2018/003977
§ 371 (c)(1),
(2) Date: Sep. 4, 2019

(87) PCT Pub. No.: WO2018/212451
PCT Pub. Date: Nov. 22, 2018

(65) Prior Publication Data

US 2020/0011315 A1 Jan. 9, 2020

(30) Foreign Application Priority Data

May 18, 2017 (KR) ..... 10-2017-0061541

(51) Int. Cl.
*F04B 17/00* (2006.01)
*F04B 39/00* (2006.01)
*F04B 39/12* (2006.01)

(52) U.S. Cl.
CPC ..... *F04B 39/0027* (2013.01); *F04B 39/0061* (2013.01); *F04B 39/123* (2013.01)

(58) Field of Classification Search
CPC ..... F04B 39/0027; F04B 39/0061; F04B 39/123; F04B 39/023; F04B 35/04; F04B 39/00; F04B 39/10; F04B 39/14
See application file for complete search history.

(56) References Cited

U.S. PATENT DOCUMENTS 5,201,640 A * 4/1993 Heinzelmann ..... F02M 35/1211 417/312
7,014,430 B2 * 3/2006 Seo ..... F04B 39/0061 181/403

(Continued)

FOREIGN PATENT DOCUMENTS

JP 2005-155438 A 6/2005
JP 2012-241681 A 12/2012

(Continued)

OTHER PUBLICATIONS

International Search Report for PCT/KR2018/003977 dated Jul. 19, 2018 from Korean Intellectual Property Office.

*Primary Examiner* — Essama Omgba
*Assistant Examiner* — Stephen A Mick
(74) *Attorney, Agent, or Firm* — Revolution IP, PLLC

(57) ABSTRACT

A cylinder coupling structure of a compact air compressor includes a block provided with a suction valve and a discharge valve to be integrally formed with a suction muffler and a discharge muffler to block a front end of the cylinder, a tubular-shaped cylinder coupled to the block, a valve cover covering the valve assembly, at least one pressurized bolt coupling the valve cover and the block, a piston reciprocating inside the cylinder, a stator coupled to the block, a rotator located to rotate relatively with respect to the stator, a crank axis coupled to the rotator to rotate integrally with the rotator to be rotatable coaxially with the block, and (Continued)

a connecting rod, each of both ends thereof being connected to the crank axis and the piston, respectively.

3 Claims, 14 Drawing Sheets

(56) References Cited

U.S. PATENT DOCUMENTS

| | | | | |
|---|---|---|---|---|
| 7,435,060 | B2 * | 10/2008 | Kim | F04B 39/0072 417/312 |
| 2008/0003115 | A1 * | 1/2008 | Kim | F04B 39/0055 417/312 |
| 2009/0214367 | A1 * | 8/2009 | Brabek | F04B 39/123 417/559 |
| 2010/0290939 | A1 * | 11/2010 | Freiberger | F04B 39/1066 417/545 |
| 2014/0322040 | A1 * | 10/2014 | Cho | F04B 39/0061 417/312 |
| 2015/0176576 | A1 * | 6/2015 | Lee | F04B 53/001 417/312 |
| 2016/0245274 | A1 * | 8/2016 | Nagura | F17C 9/02 |

FOREIGN PATENT DOCUMENTS

| | | | |
|---|---|---|---|
| KR | 20-0122684 | Y1 | 8/1998 |
| KR | 20-0387141 | Y1 | 6/2005 |
| KR | 10-0548273 | B1 | 2/2006 |
| KR | 10-2007-0096373 | A | 10/2007 |
| KR | 10-2007-0096393 | A | 10/2007 |
| KR | 10-2008-0018613 | A | 2/2008 |
| KR | 10-2010-0081807 | A | 7/2010 |
| KR | 10-1073763 | B1 | 10/2011 |
| KR | 10-2016-0055529 | A | 5/2016 |

* cited by examiner

[Fig. 1]
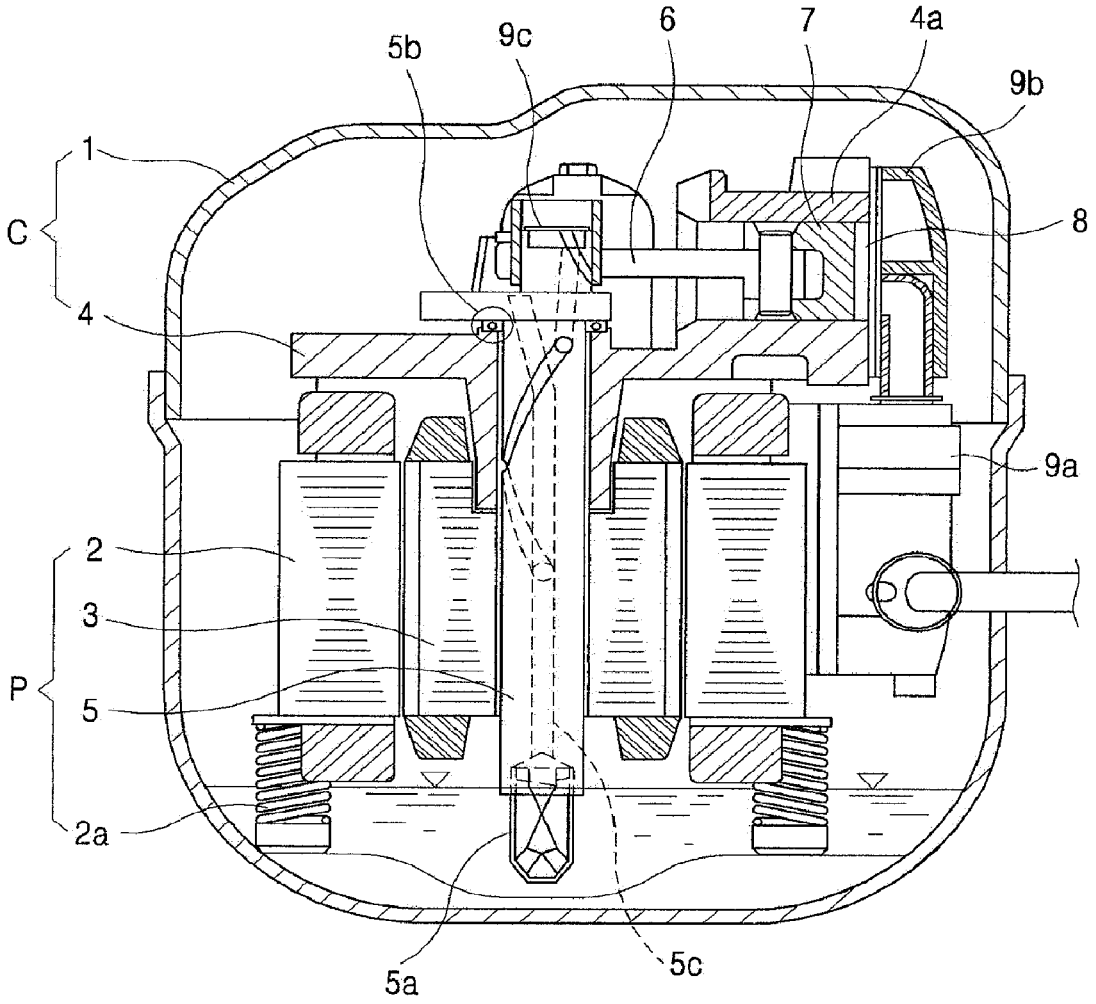
Prior Art

[Fig. 2]
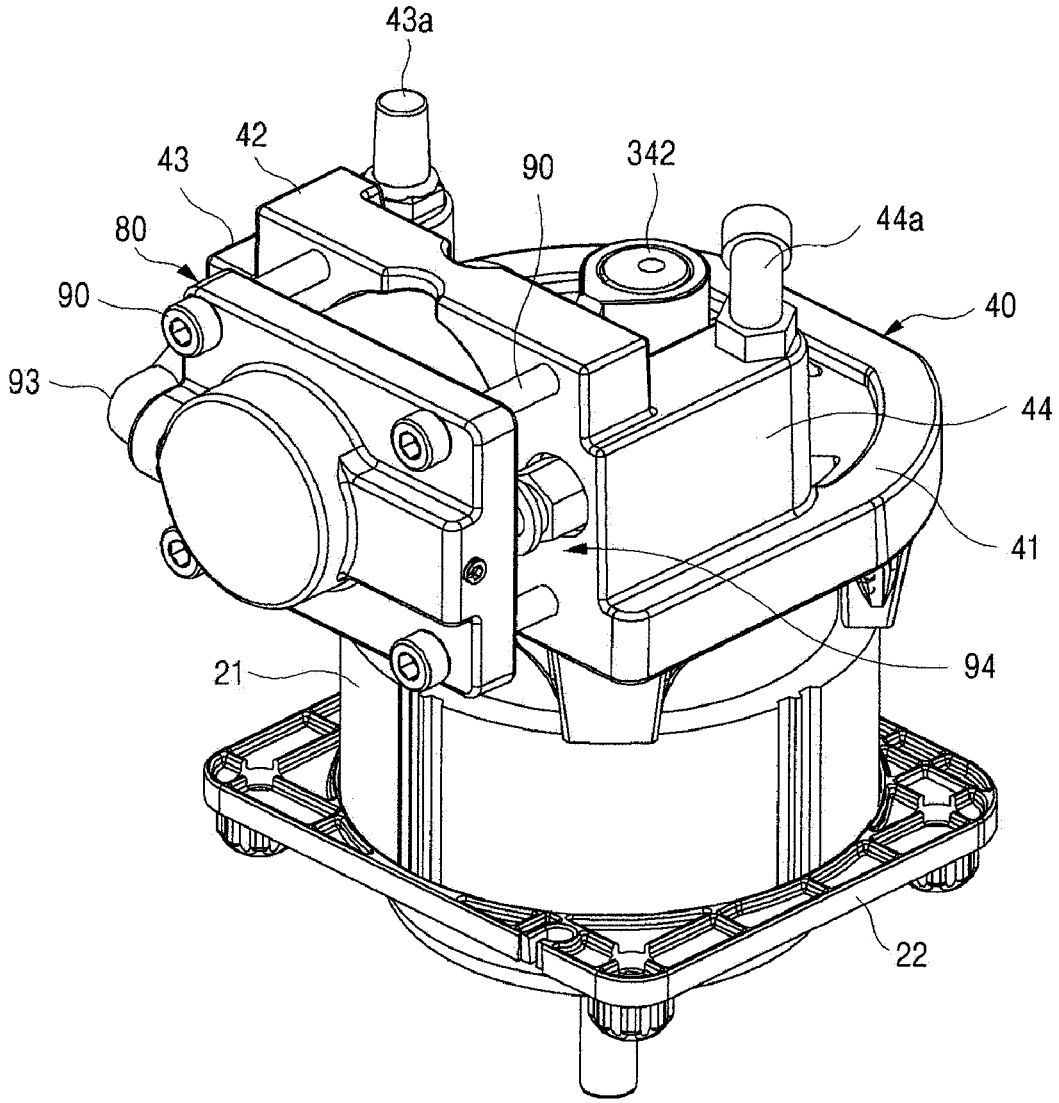

[Fig. 3]
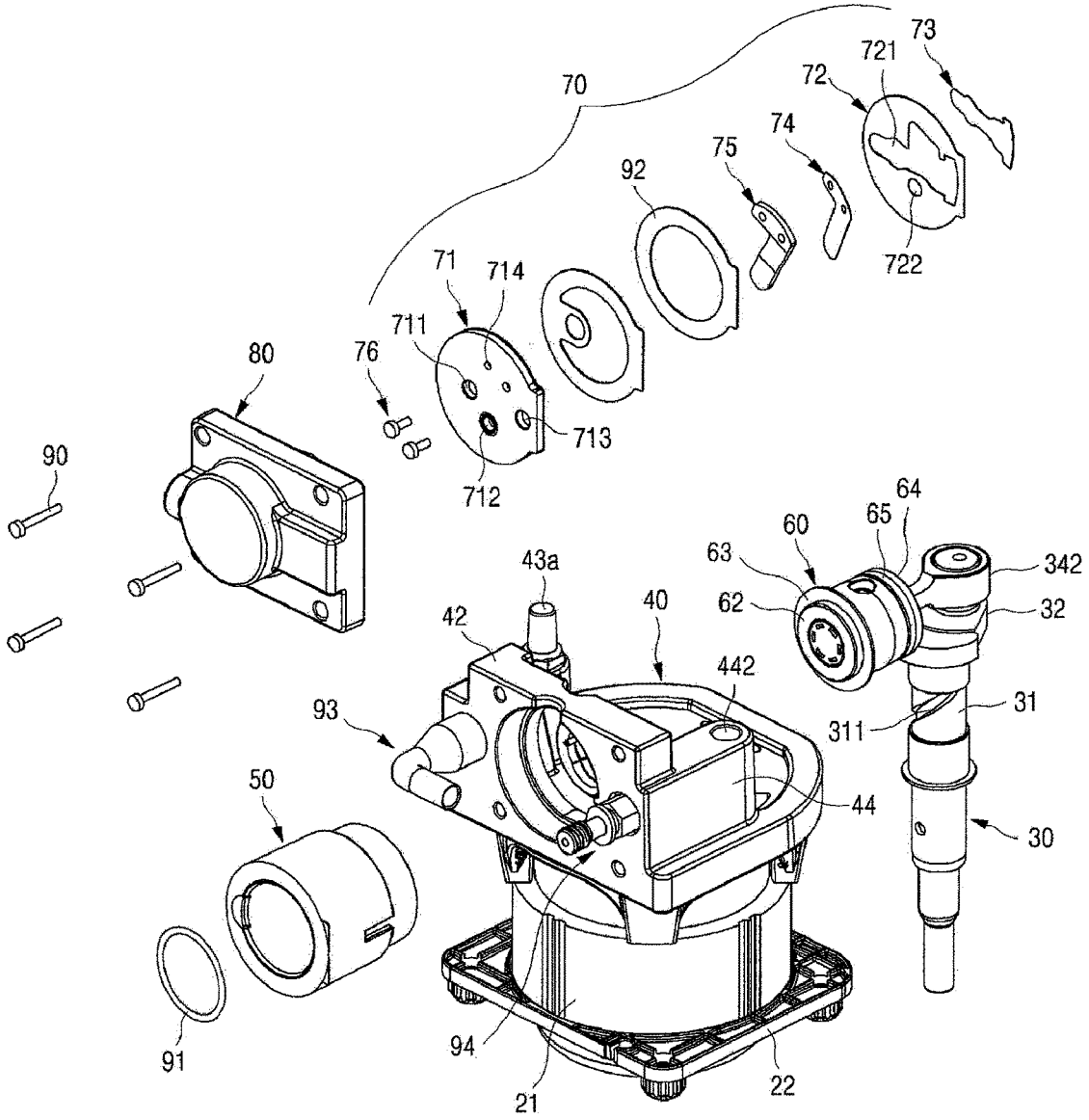

[Fig. 4]
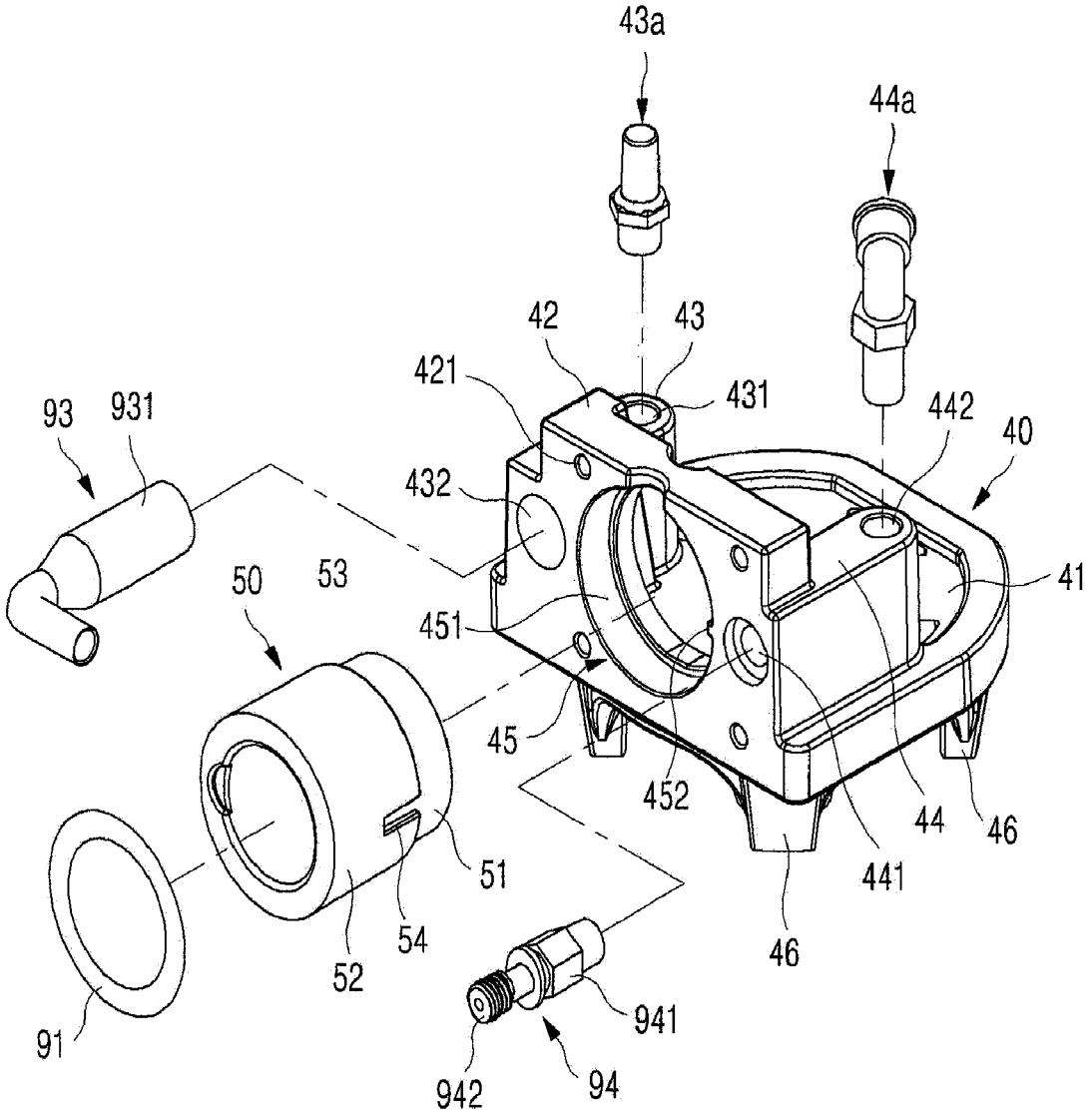

[Fig. 5]
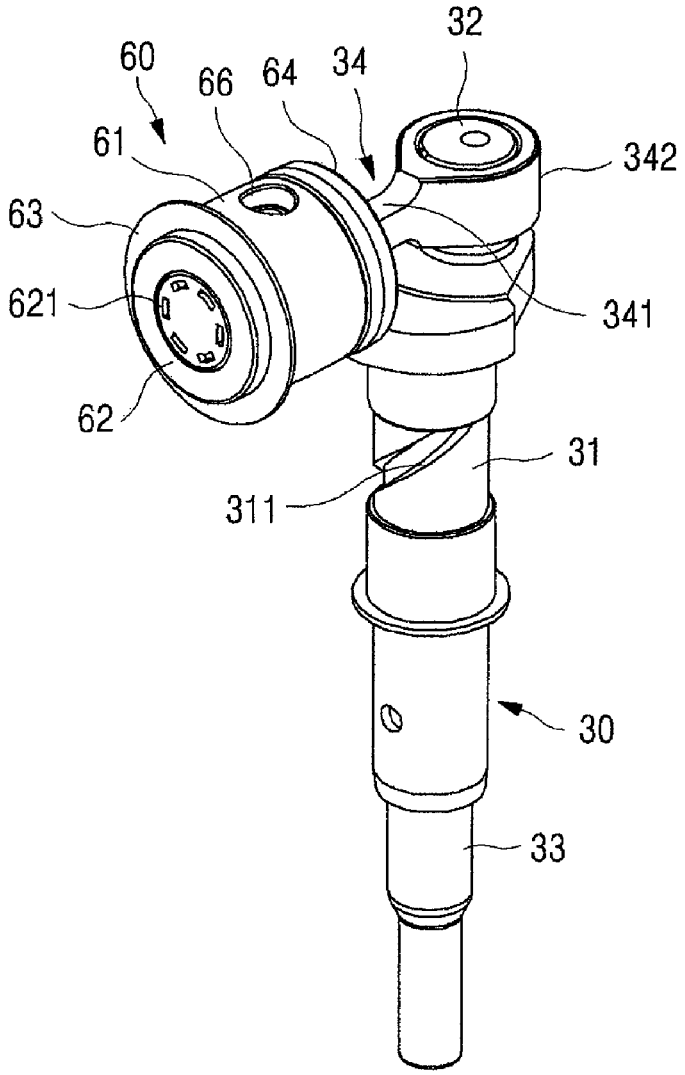

[Fig. 6]
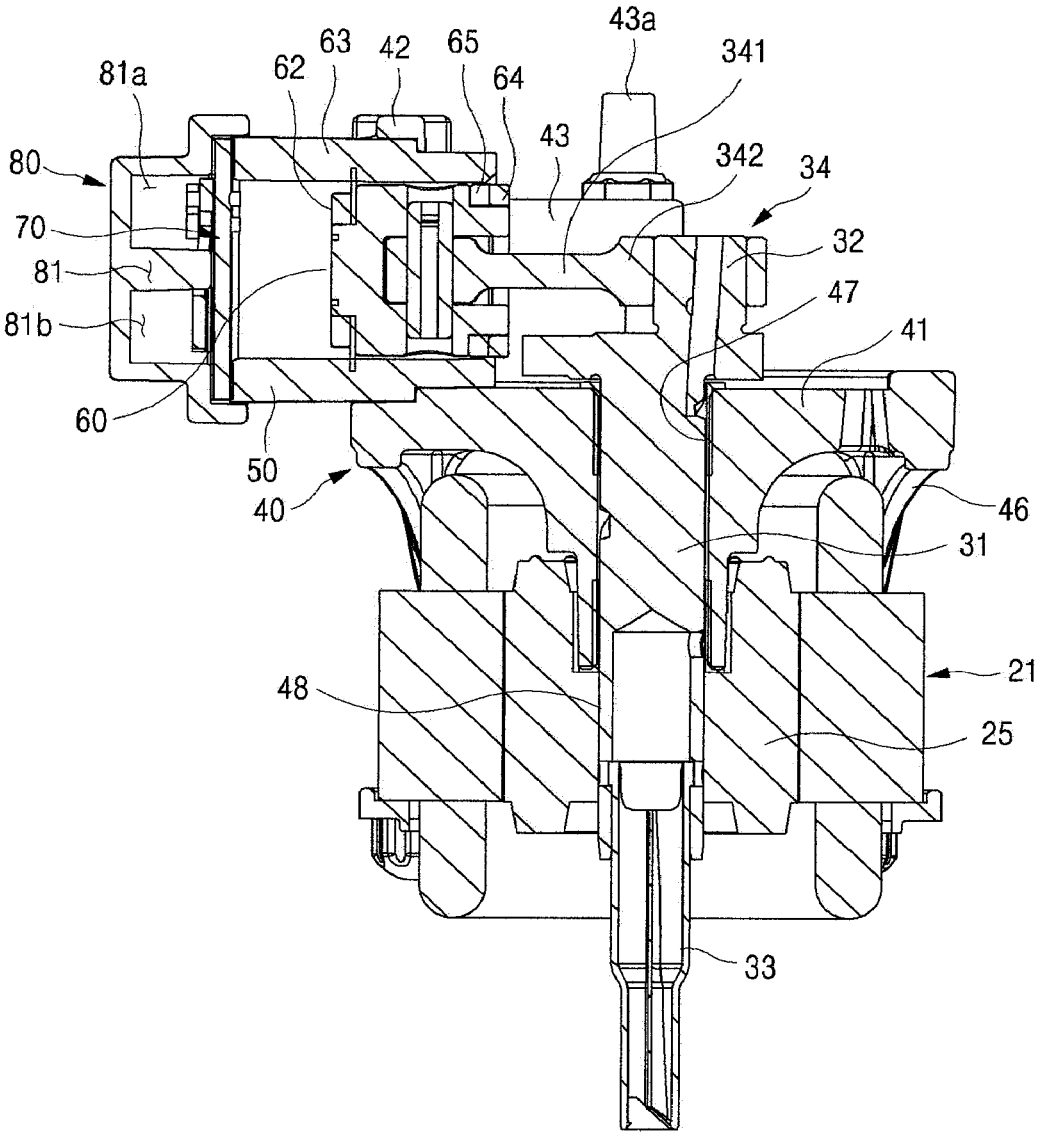

[Fig. 7]
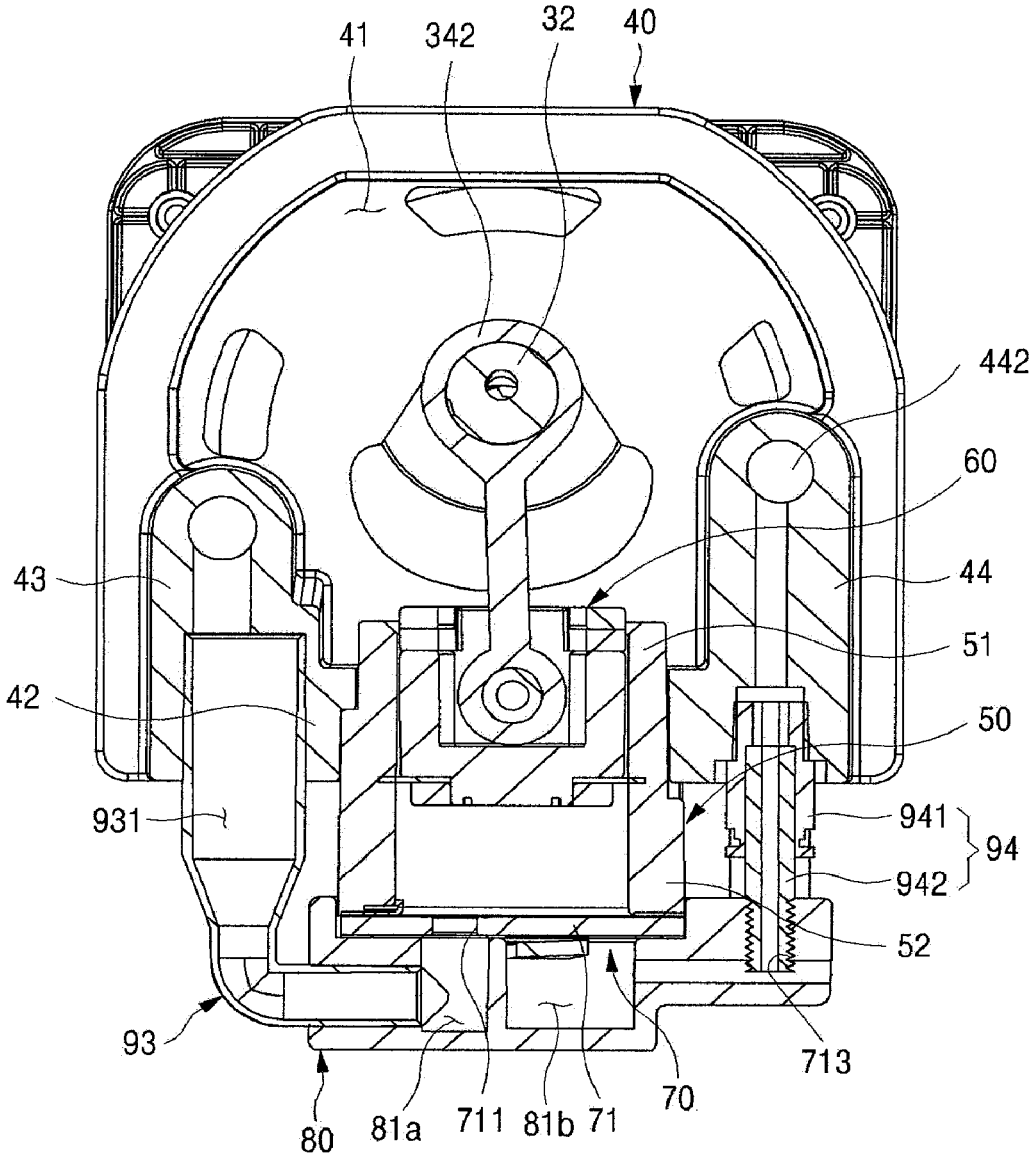

[Fig. 8]
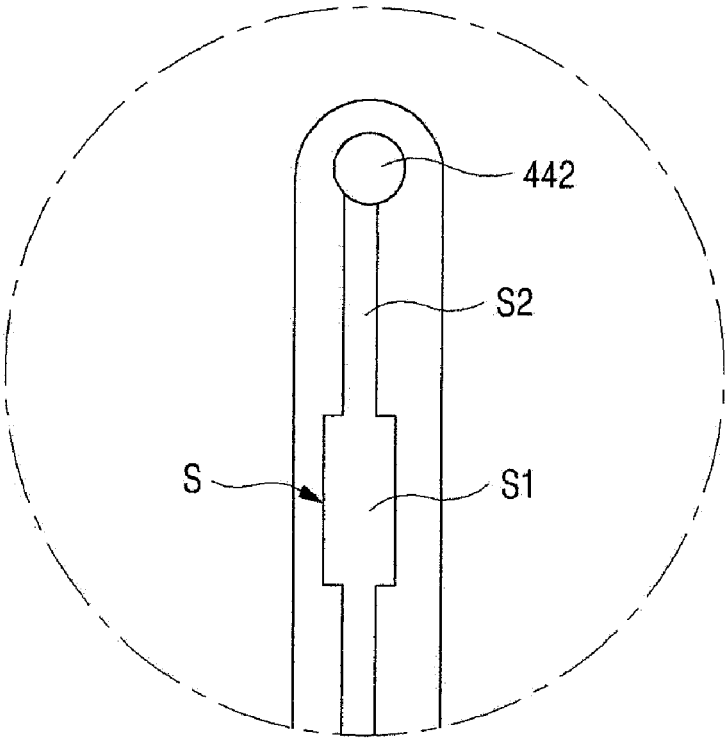

[Fig. 9]
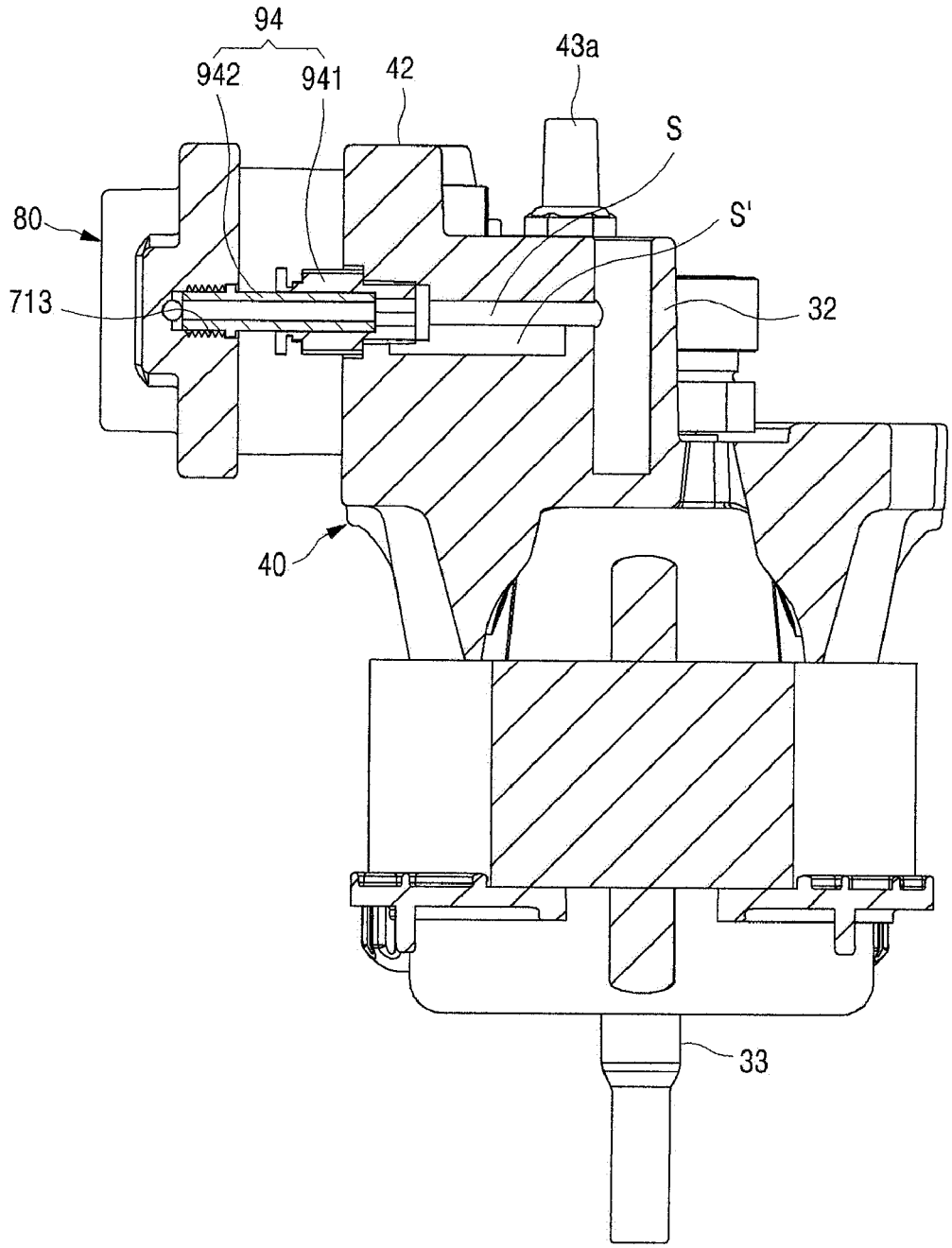

[Fig. 10]
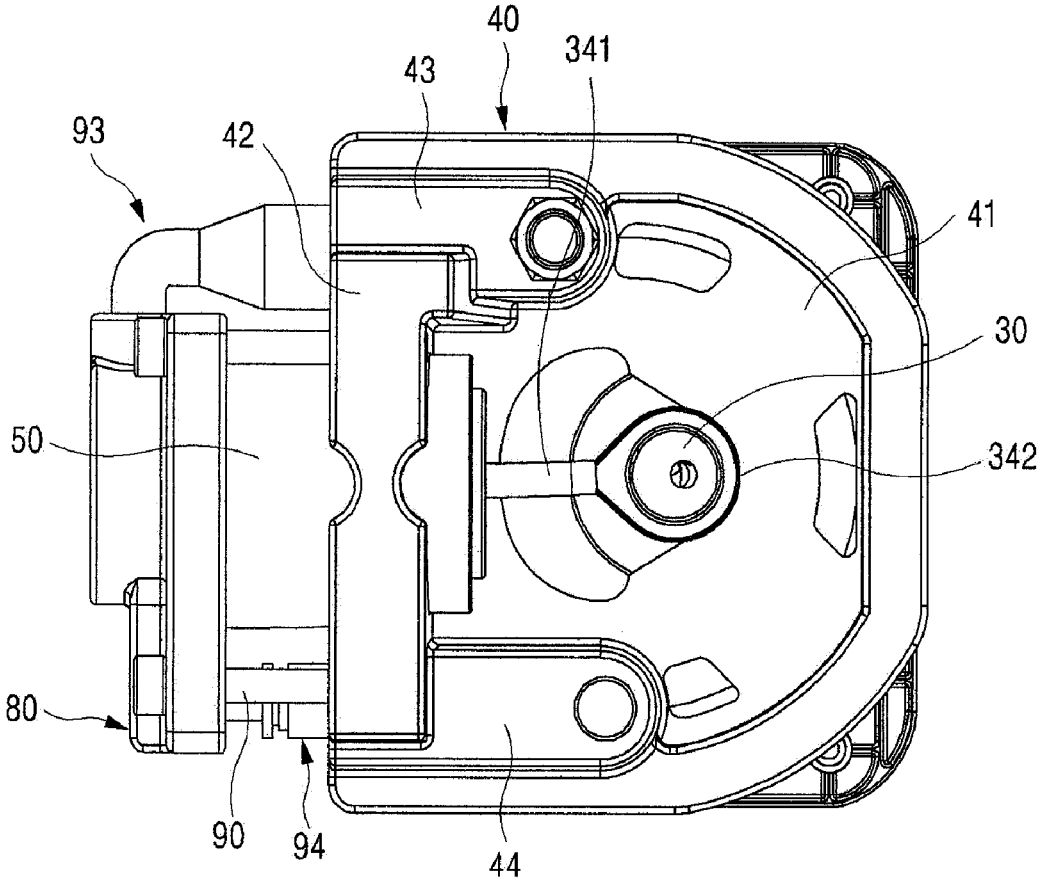

[Fig. 11]
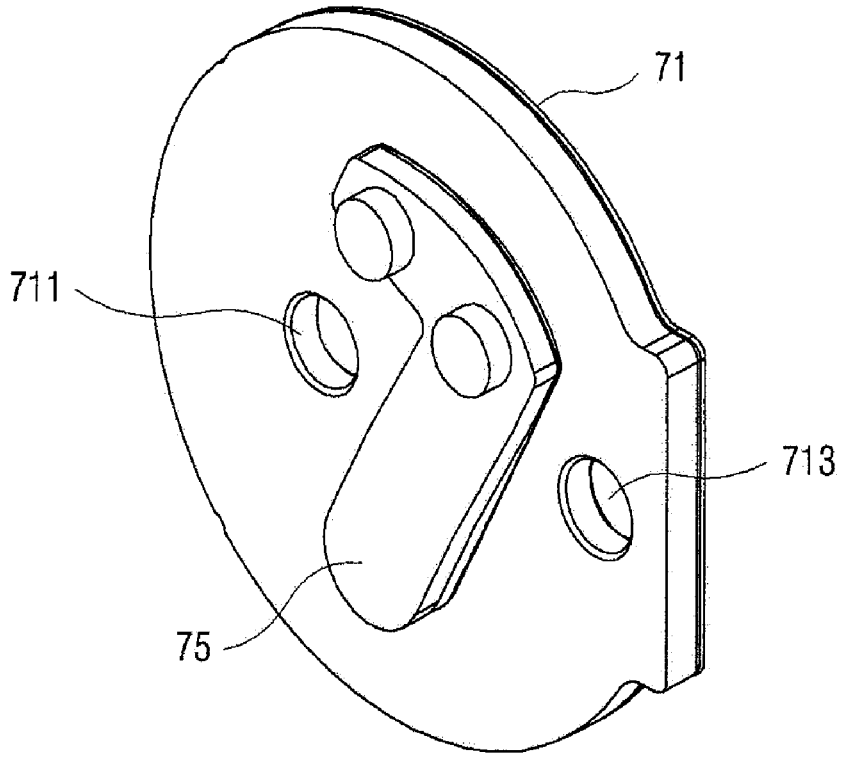

[Fig. 12]
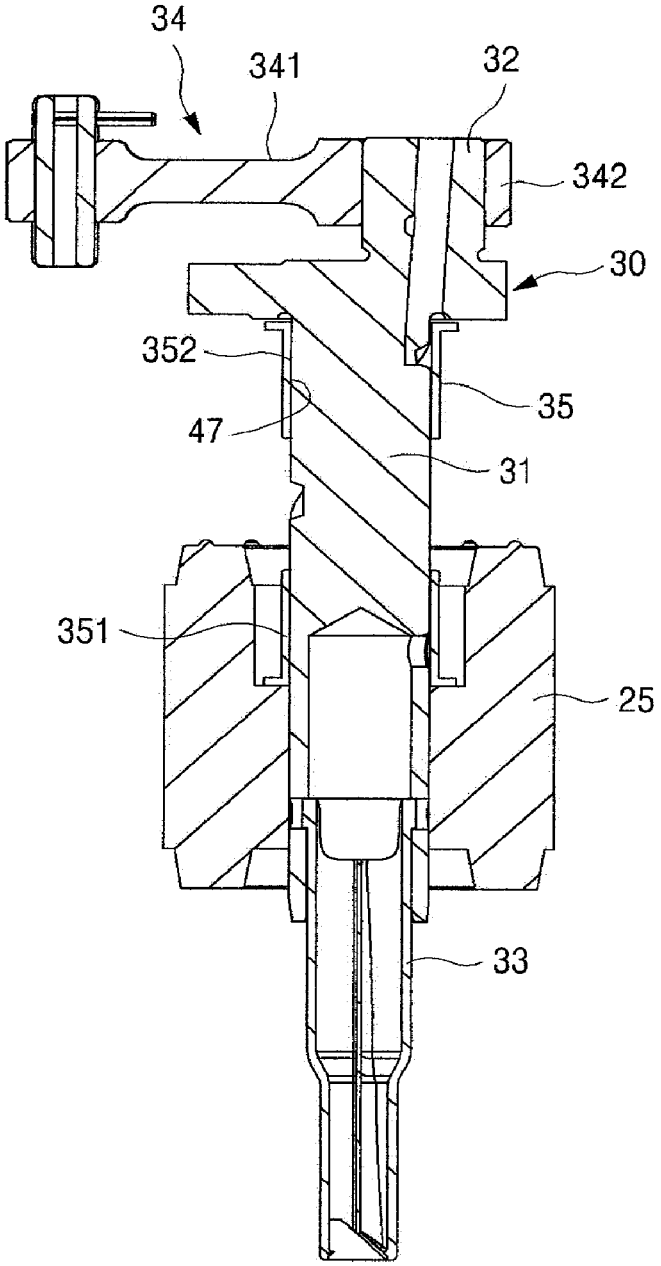

[Fig. 13]
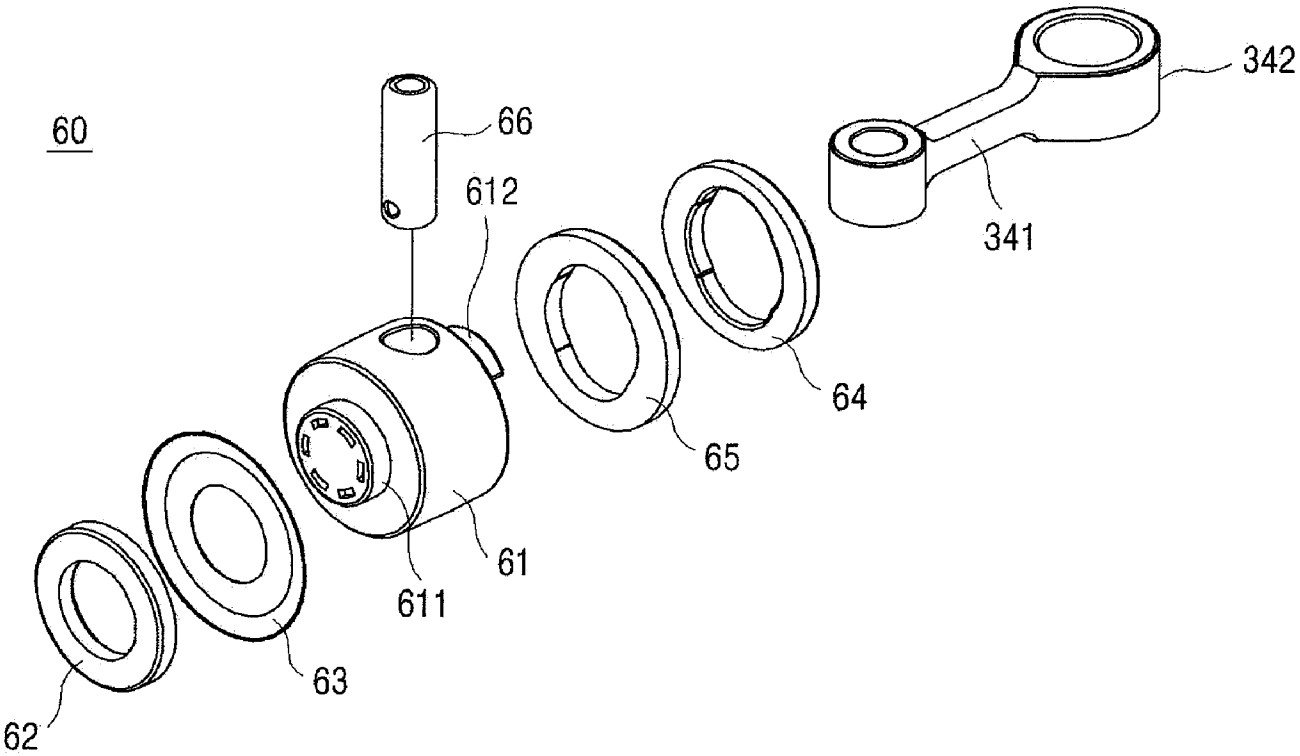

[Fig. 14]
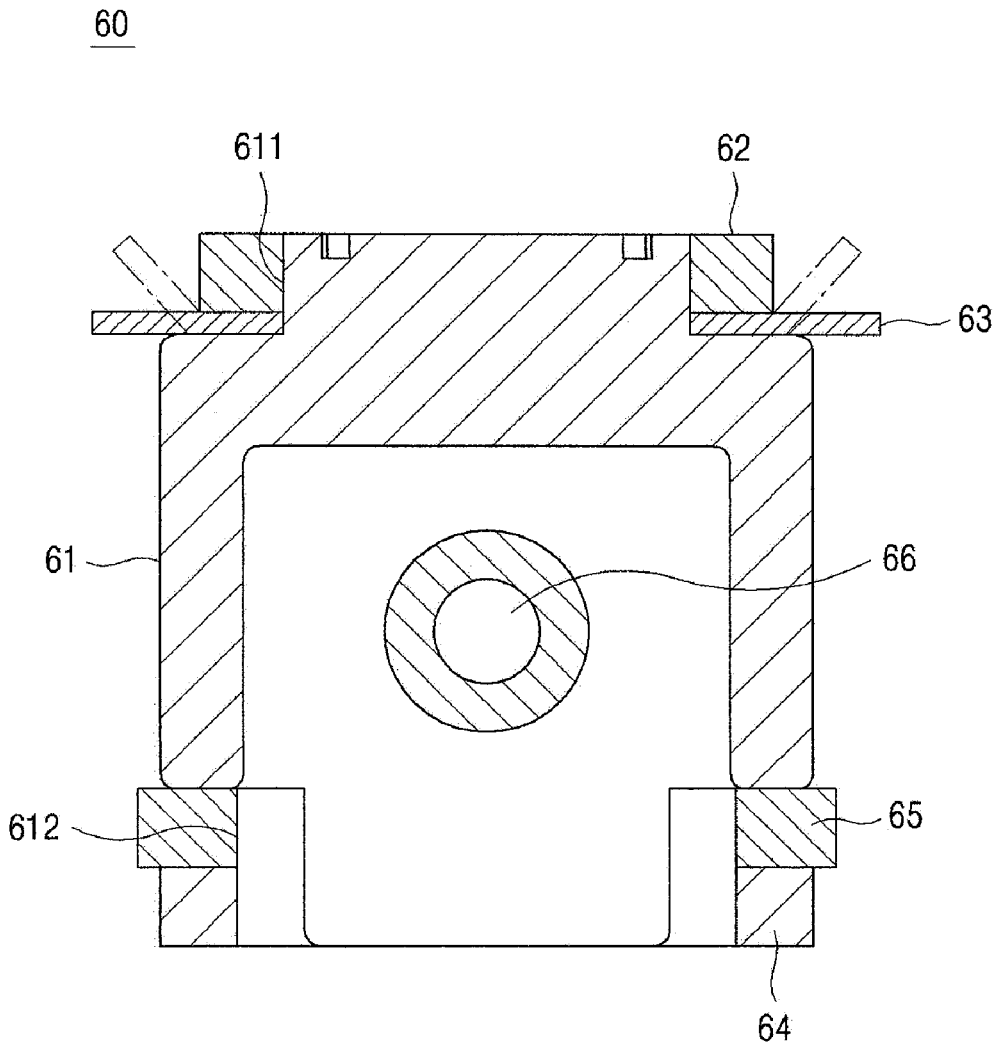

COMPACT AIR COMPRESSOR

TECHNICAL FIELD

The present invention relates to a compact air compressor. More specifically, the present invention relates to a compact air compressor in which a cylinder of a reciprocating piston type compressor which sucks in fluid such as air or a refrigerant gas and compresses the same is manufactured separately from a block and coupled thereto, thereby reducing the weight and the size of the compressor, and compressed air of high pressure is stored inside a discharge muffler and discharged to reduce discharge pulsation, thereby reducing the overall vibration noise of the air compressor.

BACKGROUND ART

Compressors are used to produce compressed air or to compress fluid such as refrigerant gas. Compressors are mainly divided into reciprocating piston type compressors which reciprocate the piston in a cylinder to compress the air and rotary vane type compressors which rotate a rotator in the cylinder to compress the air. The rotary vane type air compressors make less noise, but there is a difficulty in the production of compact products, and thus are only applied to large-scale compressors having a horsepower of 20 HP or more. The reciprocating piston type compressors are mainly applied to products with various sizes having a horsepower of 20 HP or less.

Korean Utility Model Registration No. 20-0387141 discloses a reciprocating piston type compressor for compressing air, and Korean Patent No. 10-1073763, Korean Utility Model Registration No. 20-0122684, and Korean Patent Laid-Open No. 10-2010-0081807 disclose a compact reciprocating piston type, i.e., a reciprocating compressor for compressing refrigerants in a freezer.

FIG. 1 illustrates a compact reciprocating compressor disclosed in Korean Patent Laid-Open No. 10-2010-0081807. Referring to FIG. 1*a*, the conventional ordinary compact reciprocating compressors for compressing refrigerant gas comprise a driving part P which generates a rotation power inside a case 1, and a compression part C which converts a rotational movement of the driving part Pinto a reciprocating movement to compress the refrigerant gas. The driving part P comprises a stator 2 which is elastically supported with a spring 2*a*, and a rotator 3 which is installed to be rotatable inside the stator 2.

The compression part C comprises a block 4 which is coupled to the stator 2 while being integrally formed with a cylinder pail 4*a* so as to have a compression space, a crankshaft 5 which is inserted into an axis supporting hole of the block 4 to be supported radially and axially, and is coupled to the rotator 3 of the driving part P to deliver a rotational force, a connecting rod 6 which is coupled to be rotatable to a cam part of the crankshaft 5 to conve 11*a* rotational movement into a straight movement, a piston 7 which is coupled to be rotatable to the connecting rod 6 to compress the refrigerant while conducting a straight reciprocating movement in the cylinder 4*a*, a valve assembly 8 which is coupled to a front end of the cylinder 4*a* and comprises a suction valve and a discharge valve, a suction muffler 9*a* which is coupled to the suction side of the valve assembly 8, a discharge cover 9*b* which is coupled to accommodate the discharge side of the valve assembly 8, and a discharge muffler 9*c* which communicates with the discharge cover 9*b* to reduce discharge noise of the discharged refrigerant.

According to the compact reciprocating compressor as above, when power is applied by the driving part P, the rotator 3 rotates together with the crankshaft 5 by the interaction force of the stator 2 and rotator 3, the connecting rod 6 coupled to the cam pal 1 of the crankshaft 5 conducts a turning movement, the piston 7 coupled to the connecting rod 6 compresses the refrigerant sucked into the cylinder through the suction muffler 9*a* and discharges the same to the valve cover 9*b* while conducting a straight reciprocating movement in the cylinder 4*a*, and the refrigerant discharged to the valve cover 9*b* is discharged through the discharge muffler 9*c*.

However, the conventional compact reciprocating compressor as illustrated in FIG. 1 has disadvantages that the cylinder 4*a* gets bigger for being integrally formed with the block 4, thereby requiring more casting or die casting material for manufacturing the block 4 and making the cylinder heavier, and accordingly, the expenses for distribution such as shipping expenses, etc. would cost a lot.

Meanwhile, in the case of the compact reciprocating compressor illustrated in FIG. 1, the suction muffler 9*a* and the discharge muffler 9*b* for reducing the noise generated by the pulsation of the air or refrigerant gas compressed by the reciprocating movement of the piston 7 are manufactured separately from the block 4, and thus are connected to the valve cover 4 by means of a pipe. This makes the structure of the compressor to be complex and increases manufacturing costs.

Additionally, in the case of the compact reciprocating compressor illustrated in FIG. 1, the crankshaft 5 is inserted into the axis supporting hole of the block 4 so that the end portions at both sides thereof are axially supported by a bearing 5*b* axially and radially. However, the crankshaft 5 generates a lot of vibration, and due to the vibration, a ball bearing which is commonly used can be easily damaged, and fueling is required for sure in order to reduce the noise and improve durability. Accordingly, the conventional compact reciprocating compressor illustrated in FIG. 1 adopts a structure of pumping oil at a lower oil part of the case 1 by an oil feeder Sa to supply the oil to the bearing 5*b* through an oil passage 5*c* formed in the crankshaft 5. Part of oil supplied as above is supplied to the cylinder 4*a* in order to reduce friction between the piston 7 and the cylinder 4*a*.

Especially, in the prior art, in order to reduce the noise generated by the pulsation of the air or refrigerant gas compressed by the reciprocating movement of the piston 7, the suction muffler 9*a* and the discharge muffler 9*b* are manufactured separately from the block 4 to be connected to the valve cover 4 by means of a pipe. However, according to this structure, the compressed air cannot be moved to an inner space of the block, and thus the compressed air is discharged to an outlet of the discharge muffler 9*b*. Therefore, when the air sucked in and compressed is discharged to the outlet of the discharge muffler 9*b*, the amount of the compressed air discharged to the outlet is smaller than the amount of the air sucked in and compressed. Therefore, a discharge pulsation occurs resulting from the direct discharge, and due to this, vibration noise of the air compressor increases.

DISCLOSURE OF INVENTION

Technical Problem

It is an object of the present invention to provide a compact air compressor which has a simple structure and is easy to assemble by having a suction muffler and a discharge muffler integrally formed with a block, which allows the compressed air discharged through a discharge pipe that is connected to the valve cover and guides the compressed air sucked into the valve cover to stay in a compressed air staying space inside the discharge muffler, and discharge the compressed air, so as to reduce the discharge pulsation resulting from the discharge of compressed air, thereby inhibiting the vibration noise resulting from the discharge pulsation.

Solution to Problem

In order to achieve the above object, the compact air compressor according to the present invention is characterized by comprising a block provided with a suction valve and a discharge valve to be integrally formed with a suction muffler and a discharge muffler which block a front end of the cylinder, a tubular-shaped cylinder coupled to the block, a valve cover covering the valve assembly so as to form a suction space and a discharge space at upper portion of the valve assembly, at least one pressurized bolt coupling the valve cover and the block so as to pressurize the cylinder between the valve cover and the block, a piston reciprocating inside the cylinder, a stator coupled to the block, a rotator located to rotate relatively with respect to the stator, a crankshaft coupled to the rotator to rotate integrally with the rotator to be rotatable coaxially with the block, and a connecting rod, each of both ends thereof being connected to the crankshaft and the piston, respectively, so as to convert a rotational movement of the crankshaft into a straight reciprocating movement of the piston, a discharge connection pipe which is connected to the valve cover and guides the compressed air sucked into the valve cover; and a compressed air staying space of the discharge muffler connected to the discharge connection pipe.

Advantageous Effects of Invention

Thanks to the above features, the compact air compressor according to the present invention has a simple structure and is easy to assemble by having a suction muffler and a discharge muffler integrally formed with a block.

Additionally, the compact air compressor according to the present invention allows the compressed air which is sucked in and compressed by the suction muffler to stay in the compressed air staying space inside the discharge muffler through the discharge connection pipe connected to the discharge space inside the valve cover, and then be discharged, eliminates the difference between the amount of air sucked in and the amount of the compressed air discharged to inhibit the vibration noise resulting from the discharge pulsation, thereby promoting improvement in the performance of the compressor.

BRIEF DESCRIPTION OF DRAWINGS

FIG. 1 is a drawing illustrating a structure of a conventional compact reciprocating compressor in which a cylinder is integrally formed with a block;

FIG. 2 is a perspective view illustrating a compact air compressor to which a cylinder coupling structure according to an embodiment of the present invention is applied;

FIG. 3 is an exploded perspective view illustrating a compact air compressor to which a cylinder coupling structure according to an embodiment of the present invention is applied;

FIG. 4 is an exploded perspective view illustrating a valve assembly of the compact air compressor to which the cylinder coupling structure according to an embodiment of the present invention is applied;

FIG. 5 is a perspective view illustrating a crankshaft of the compact air compressor to which the cylinder coupling structure according to an embodiment of the present invention is applied;

FIG. 6 is a cross-sectional view illustrating a crankshaft of the compact air compressor to which the cylinder coupling structure according to an embodiment of the present invention is applied;

FIG. 7 is a horizontal cross-sectional view illustrating a compact air compressor to which the cylinder coupling structure according to an embodiment of the present invention is applied;

FIG. 8 is a partial horizontal cross-sectional view according to another embodiment of the present invention;

FIG. 9 is a partial side cross-sectional view according to yet another embodiment of the present invention;

FIG. 10 is a plan view illustrating a compact air compressor to which the cylinder coupling structure according to an embodiment of the present invention is applied;

FIG. 11 is an excerpted perspective view illustrating a valve plate of the compact air compressor to which the cylinder coupling structure according to an embodiment of the present invention is applied;

FIG. 12 is a cross-sectional view illustrating a crankshaft of the compact air compressor to which the cylinder coupling structure according to an embodiment of the present invention is applied;

FIG. 13 is an exploded perspective view illustrating a structure of a piston of the compact air compressor according to another embodiment of the present invention; and FIG. 14 is a cross-sectional view of an embodiment of the present invention in which an O-ring is installed.

Hereinafter, the present invention will be explained in detail with reference to the attached drawings.

MODE FOR THE INVENTION

Referring to the attached drawings, the compact air compressor to which the cylinder coupling structure according to an embodiment of the present invention is applied comprises a housing, a stator 21, a rotator 25, a crankshaft 30, a connecting rod 34, a block 40, a cylinder 50, a piston 60, a valve assembly 70, a valve cover 80, and a pressurized bolt 90.

Although the housing is not illustrated, the housing is a case generally used for accommodating an assembly thereof so that the assembly in which the stator 21, the block 40, etc. are assembled could be protected, and comprises a bottom pm-t, a side wall part which is extended upwardly from an outer edge of the bottom part and formed in a tubular shape whose upper and lower sides are open, and a cover part for covering an upper opening of the side wall part. The bottom part, the side wall part and the cover part are integrally coupled in a state where each of the bottom part and the side wall part is sequentially placed up and down so as to block the upper and lower openings of the cover part. The housing is sealed to block the noise generated during the pumping operation and to prevent oil such as lubricating oil, etc. from leaking outside.

The stator 21 generates a magnetic force for rotating the rotator 25 when electricity is applied, and is fixed to the bottom part of the housing. In order to be fixed, the stator 21 is coupled to a fixed plate 22 in an upright position.

As will be mentioned later, the stator 21 meets a stator coupling pillar 46 protruding downwardly from an axis supporting part 41 of the block 40 to be integrally coupled to the block 40.

The rotator 25 is located inside the stator 21 to rotate relatively with respect to the stator 21. The crankshaft 30 is coupled to the rotator 25 to rotate integrally with the rotator 25.

The crankshaft 30 is coupled to the rotator 25 to rotate integrally with the rotator 25 to be rotatable coaxially with the block 40. Referring to the drawings, the crankshaft 30 is integrally formed with a crank part 32 in which the connecting rod 34 is connected to an upper portion of an axis part 31, and an oil feeder 33 for moving the lubricating oil contained in the bottom part of the housing to the crankshaft 30 is coupled to a lower portion of the axis part 31. The lubricating oil pumped by the oil feeder 33 is supplied to the surface of the crankshaft 30 following an oil passage 311 such as a groove or a hole formed in the crankshaft 30.

The axis part 31 of the crankshaft 30 is axially supported in the axis supporting part 41 of the block 40. An axis hole 47 penetrating up and down is formed in the axis supporting part 41 of the block 40, and the axis part 31 is inserted to be rotatable and axially supported in a journal 35 inserted into the axis hole 47.

The crank part 32 of the crankshaft 30 is a feature relating to cam mechanism for converting the rotation of the crankshaft 30 into the reciprocating movement of the piston 60 together with the connecting rod 34.

Each of both ends of the connecting rod 34 is connected to the crankshaft 30 and piston 60, respectively, so as to convert a rotational movement of the crankshaft 30 into a straight reciprocating movement of the piston 60. Referring to the drawings, the connecting rod 34 is divided into a rod part 341 which is connected to the piston 60 by a connecting pin 66, and a journal part 342 connected to the crank part 32 of the crankshaft 30. The divided rod part 341 and the journal part 342 are integrally connected.

The block 40 axially supports the crankshaft 30, and allows the cylinder 50 to be coupled.

According to the present invention, a cylinder 50 is not integrally formed with the block 40, but is formed separately to be coupled to the cylinder coupling part 42 of the block 40. Referring to the drawings, the block 40 has a horizontal plate-shaped axis supporting part 41 in which the crankshaft 30 is axially supported, and a plate-shaped cylinder coupling part 42 which is upright to the axis supporting part 41.

An axis supporting hole 47 is formed in the axis supporting part 41 of the block 30, and a tubular-shaped journal 35 is insertedly fixed in the axis supporting hole 47. The crankshaft 30 is inserted and axially supported in the journal 35.

The journal 35 smoothly supports the rotation of the crankshaft 30 and is formed of materials having wear resistance such as bronze, so that the crankshaft 30 directly contacts the journal by sliding to be supported thereby.

Meanwhile, the present invention may have a structure where the crankshaft 30 is not directly supported by the journal 35, but is supported by bushings 351, 352 made of a resin material coupled to each inlet at both sides of the journal 35. When the crankshaft 30 is supported by bushings 351, 352 made of a resin material as an embodiment where the bushings 351, 352 made of a resin material such as poly phenylene sulfide (PPS) having excellent heat resistance and wear resistance are inserted into each inlet at both sides of the journal 35, and the axis part 341 of the crankshaft 30 is inserted into the bushings 351, 352 and is supported thereby, the present invention may have a structure reducing the fueling of oil or an oil-free axial support structure which does not require fueling at all. In the case of oil-free axis support, the feature relating to an oil feeder 33 or an oil passage 311 described in the above may be deleted from the present invention, and accordingly, it becomes easier to reduce weight and size.

The present invention has a structure where the cylinder 50 is manufactured separately from the block 40 and coupled to the cylinder coupling part 42 of the block 40. A cylinder insertion hole 45 which is arranged to be perpendicular to the axis supporting hole 47 is formed in the cylinder coupling part 42. The cylinder insertion hole 45 is formed to have one end part of the cylinder 50 inserted into the cylinder coupling part 42 and penetrated there through. The cylinder insertion hole 45 is divided into a part where the inner diameter at a side in which the crankshaft 30 is located is smaller and a part where the inner diameter at a side opposite to the crankshaft 30 is larger to form a step, and by the step, a supporting end 451 for supporting an engagement end 53 of the cylinder 50 is formed. The cylinder 50 is inserted into the cylinder insertion hole 45, so that the engagement end 53 is engaged and supported in the supporting end 451 formed by the step formed in an inner wall of the cylinder insertion hole 45.

In the cylinder insertion hole 45, a guide protrusion 452 corresponding to the guide groove 54 formed in the outer wall of the cylinder 50 is formed to be long in the longitudinal direction along the inner wall of the cylinder insertion hole 45 at a part where the inner diameter is larger in order to guide the insertion of the cylinder 50. While the cylinder 50 is inserted into the cylinder insertion hole 45, the guide protrusion 452 is inserted into the guide groove 54 formed at the outer surface of the cylinder 50 so that the cylinder 50 is inserted into the cylinder insertion hole 45 while moving only in the longitudinal direction.

Meanwhile, the present invention has a structure where the suction muffler 43 and the discharge muffler 44 are integrally formed with the block 40 in order to reduce the noise generated by the pulsation of fluid generated during the pumping operation. Referring to the drawings, the suction muffler 43 and the discharge muffler 44 are formed at each of both sides of the axis supporting part 41 by which the axis is supported. Especially, the cylinder coupling part 42 is located between the suction muffler 43 and discharge muffler 44. Each end portion of the suction muffler 43 and the discharge muffler 44 is connected to each of both sides of the axis supporting part 41, and thus is interconnected with each other in a structure arranged in the shape of "i" in the order of the suction muffler 43, the cylinder coupling part 42 and the discharge muffler 44, thereby forming a structure where rigidity of the block 40 is reinforced. An inlet 431 through which the fluid flows in and an outlet 432 through which the fluid is discharged are formed in the suction muffler 43. A suction filter **43*a* for filtering impurities included in the air or refrigerant sucked in is coupled to the inlet 431 of the suction muffler 43, and a suction connection pipe 93 is connected to the outlet 432 of the suction muffler 43, and accordingly the suction muffler 43 is connected to the suction space 81*a* of the valve cover 80. Additionally, an inlet 441 through which the fluid flows in and an outlet 442 through which the fluid is discharged are formed in the discharge muffler 44. A discharge connection pipe 94 is connected to the inlet 441 of the discharge muffler 44, and accordingly the discharge muffler 44 is connected to the discharge space 81***b* of the valve cover 80, and a pipe connection hole 44*a* is coupled to the outlet 442 of the discharge muffler 44.

The suction connection pipe 93 is in a tubular shape for connecting the suction muffler 43 and the suction space 81*a* of the valve cover 80. Referring to the drawings, one end of the suction connection pipe 93 is connected to the outlet 432 of the suction muffler 43, and another end thereof is connected to the inlet formed in the suction space 81*a* of the valve cover 80. Meanwhile, the present invention is characterized in that a supplemental suction muffler part 931 is formed in the suction connection pipe 93 in order to reduce the noise resulting from the suction pulsation of the fluid together with the suction muffler 43. The supplemental suction muffler part 931 is achieved by an expanded space.

The discharge connection pipe 94 is in a tubular shape for connecting the discharge muffler 44 and the discharge space 81*b* of the valve cover 80. Referring to the drawings, one end of the discharge connection pipe 94 is connected to the inlet 441 of the discharge muffler 44, and another end thereof is connected to the discharge hole 713 formed in the discharge space 81*b* of the valve cover 80.

Meanwhile, the present invention has a structure where the discharge connection pipe 94 is divided into a pit pipe 942 and a pit 941 and then the two are coupled so that the discharge connection pipe 94 could be easily assembled while the cylinder 50, the valve assembly 70 and the valve cover 80 are coupled to the block 40 by a pressurized bolt 90. Referring to the drawings, the pit pipe 942 is coupled to the discharge hole 713 of the valve plate 71 to be protruded in a direction where the valve cover 80 pressurizes the cylinder. Additionally, the pit 941 proceeds in a direction where the valve cover 80 pressurizes the cylinder 50, and is protruded in a direction facing the pit pipe 942 so that the pit pipe 942 is insertedly connected, thereby being connected to the inlet 441 of the discharge muffler 44.

In the drawings, the pit pipe 942 is insertedly coupled to the pit 941. However, this was for the sake of convenience, and the pit pipe 942 is coupled to the valve plate 71 in advance, and the pit pipe 942 and the pit 941 are coupled to each other. A distal end of the pit pipe 942 is inserted into the inlet of the pit 942 connected to the discharge muffler 44 when assembling the valve cover 80.

As illustrated in FIGS. 7 and 8, a compressed air staying space S may be provided inside the discharge muffler 44, and a compressed air staying inlet 51 of the staying space S may be formed to be broader than an outlet S2.

Additionally, as illustrated in FIG. 9, a staying recess part S' may be formed immediately below the staying space S to allow a great amount of compressed air to stay.

Accordingly, the air sucked into the suction space 81*a* inside the valve cover 80 is compressed inside the cylinder 50, and then is discharged to the discharge space 81*b* of the valve cover 80. The compressed air discharged is first discharged to the compressed air staying space S inside the discharge muffler 44 through the discharge connection pipe 94 and stays there. The compressed air staying in the staying space operates an air gun so that a greater amount of compressed air could be discharged to the outside when discharging the compressed air, and thus the vibration noise generated by the discharge pulsation can be greatly reduced.

In addition, according to the present invention, the compressed air staying inlet S1 of the compressed air staying space S is formed to be broader than the outlet S2, and thus a greater amount of compressed air stays in the compressed air inlet S1, which allows the compressed air staying at the time of discharging compressed air by an air gun to be discharged through the outlet S2 of the compressed air staying space S more quickly.

The cylinder 50 is formed in the shape of a circular tube so as to form a space where fluid such as air or a refrigerant is compressed by the reciprocating movement of the piston 60. The present invention is characterized in that the cylinder 50 is formed separately from the block 40 and coupled to the block 40. Especially, an engagement end 53 is formed at the side part of the cylinder 50 so that the engagement end 53 is engaged in and supported by the supporting end 451 formed inside the cylinder insertion hole 45 of the block 40. Referring to the drawings, the cylinder 50 has a small diameter part 51 with a small external diameter formed at the side inserted into the cylinder insertion hole 45 of the block 40, and a large diameter part 52 whose external diameter is greater than the small diameter part 51 formed at the side to which the valve assembly 70 and the valve cover 80 are coupled. The step formed by the small diameter part 51 and large diameter part 52 becomes the engagement end 53. The small diameter part 51 is inserted into a part having a small inner diameter in the cylinder insertion hole 54, and the large diameter part 52 is inserted into a part having a large inner diameter in the cylinder insertion hole 54, and accordingly the engagement end 53 is engaged in and supported by the supporting end 451 of the cylinder insertion hole 54. In other words, the pressurized bolt 90 fastens the block 40 and the valve cover 80 so that the cylinder 50 is coupled to the block 40, which allows the valve cover 90 to pressurize the front end of the cylinder 50 while the engagement end 53 of the cylinder 50 is engaged in and supported by the supporting end 451. As mentioned above, a guide groove 54 to have a guide protrusion 452 formed on the inner surface of the cylinder insertion hole 45 inserted therein is formed on the outer surface of the cylinder 50 so that the cylinder 50 is guided while being inserted into the cylinder insertion hole 45 without rotating while the cylinder 50 is inse11ed into the cylinder insertion hole 45 and coupled to the block 40. Referring to the drawings, the guide protrusion 452 is formed by cutting the large diameter part 52 in the longitudinal direction of the cylinder 50 in a predetermined depth starting from the engagement end 53 of the cylinder 50.

Meanwhile, the drawings illustrate an embodiment where the guide protrusion 452 is formed on the inner surface of the cylinder insertion hole 45, and the guide groove 54 is formed on the outer surface of the cylinder 50, but they may be formed at opposite locations. In other words, contrary to the illustrated drawings, the guide protrusion may be formed on the outer surface of the cylinder 50, and the guide groove may be formed on the inner surface of the cylinder insertion hole 45.

The piston 60 reciprocates inside the cylinder 50 so as to compress and discharge fluid such as air or a refrigerant sucked into the cylinder 50. The piston 60 is connected to the connecting rod 34 by the connecting pin 66 so as to convert a rotational movement of the crankshaft 30 into a straight movement, and then conduct the straight reciprocating movement.

Meanwhile, the present invention has a structure which can improve the assembling efficiency and compressive sealing property of the piston 60. This piston 60 has a structure where O-rings 63, 65 are installed on each of the front end and the rear end of the tubular-shaped body 61 whose front end is closed and rear end is open. As above, the O-rings 63, 65 are installed on each of the front end and the rear end, so that the front end and the rear end are closely supported in the inner surface of the cylinder 50, and thus the sealing property may be improved, thereby preventing the piston 60 from vibrating inside the cylinder 50. In the present invention, the O-rings 63, 65 are made of a Teflon material, not a rubber material, thereby securing the sealing property and mechanical nature such as wear resistance, which results in reducing or eliminating the fueling of oil to implement an oil-free structure. Especially, by adopting the O-rings 63, 65 made of a Teflon material as above so that the O-rings 63, 65 can be coupled to the piston 60 easily, the present invention has a structure where the O-rings 63, 65 are coupled to the piston 60 by cutting and forming ring insertion ends 611, 612 in each of a front end part and a rear end part of the body 61 of the cylinder 50, inserting the O-rings 63, 65 into each of the cut insertion ends 611, 612 in order, and inserting fixing rings 62, 64 in the outer side thereof to fix the piston 60. The fixing rings 62, 64 are press-fitted in the ring insertion ends 611, 612 to be coupled to the piston 60. Additionally, simultaneously with the press-fitting coupling or separately from the press-fitting coupling, the fixing rings 62, 64 can be coupled to the body 61 of the piston 60 by allowing the part connected to the body 61 of the piston 60 to be caulked while the fixing rings 62, 64 are inserted into the ring insertion ends 611, 612.

Among the O-rings 63, 65, the O-ring 63 coupled to the front end part of the piston body 61 mainly acts in sealing the cylinder 50 and the piston 60. As mentioned in the above, according to the present invention, the O-ring 63 coupled to the front end part of the body 61 is made of a Teflon material, so as to have a circular truncated cone shape inclined from the inner diameter of the O-ring 63 coupled to the front end part of the body 61 to the outer diameter thereof for enduring the compressed pressure, and thus the outer diameter faces the front end direction. Additionally, the outer edge of the O-ring 63 coupled to the front end part of the body 61 is modified to be inclined toward the front end part of the piston 60, and thus may have a donut shape.

The valve assembly 70 comprises a suction valve and a discharge valve to block the front end of the cylinder. The valve assembly 70 comprises a valve plate 71 which blocks the front end opening of the cylinder 50. A suction space 81*a* formed by the valve cover 80 and a suction hole 711 which connects the compressed space formed inside the cylinder 50 are formed in the valve plate 71. Additionally, a discharge space 81*b* formed by the valve cover 80 and a discharge hole 712 which connects the compressed space formed inside the cylinder 50 are formed in the valve plate 71. A suction valve flip 73 made of an elastic material is coupled to the inner side of the valve plate 71 so that the suction hole 711 is open only in the direction where the fluid is sucked in from the suction space 81*a* to the compressed space of the cylinder 50, and a discharge valve flip 74 made of an elastic material is coupled to the outer side of the valve plate 71 so that the discharge hole 712 is open only in the direction where the fluid is discharged from the compressed space of the cylinder 50 to the discharge space 81*b*.

Meanwhile, in order to prevent the discharge valve flip 74 from being excessively open, a valve stopper 75 is coupled to the outer side of the valve plate 71 so as to be located on the upper portion of the discharge valve flip 73. The valve stopper 75 has a shape corresponding to the discharge valve flip 73, and is coupled to the discharge valve flip 73 and the outer side of the valve plate 71 at the same time by a rivet 76 coupled to a rivet fastening hole 714 formed in the valve plate 71.

Meanwhile, a discharge hole 713 to which a discharge connection pipe 94, which connects the discharge space 81*b* and the discharge muffler 44, is connected is formed in the valve plate 71 so that the compressed fluid discharged to the discharge space 81*b* of the valve cover 80 could be discharged to the discharge muffler 44.

The valve assembly 70 coupled as above is placed to block the front end opening of the cylinder 50, and thus is coupled to the cylinder 50 by the fastening of the pressurized bolt 90 together with the valve cover 80. In order to seal the part in contact with the cylinder 50, a cylinder gasket 91 is provided in the edge of the front end opening of the cylinder 50, and a plate gasket 72 is provided in an inner side surface of the valve plate 71. In the plate gasket 72, a flip mount hole 721 which has the suction valve flip 73 mounted thereon is formed, and a discharge hole 722 is formed so that the discharge hole 712 of the valve plate is not blocked.

The valve cover 80 covers the valve assembly so as to cover the upper portion of the valve assembly 70 and to form a suction space 81*a* and a discharge space 81*b* on the upper portion of the valve assembly 70. A diaphragm 81 for dividing the suction space 81*a* and the discharge space 81*b* is formed in the inner side of the valve cover 80, and coupled to the upper portion of the valve plate 71 so as to cover the upper portion of the valve plate 71 in a state having the cover gasket 92 interposed therein for sealing. The present invention has a structure where the valve cover 80 is coupled to the block 40 by the pressurized bolt 90, so that the valve cover 80 presses the valve plate 70, and then the cylinder 50 is pressurized to be coupled to the block 40.

As mentioned above, the pressurized bolt 90 is a feature for having the cylinder 50, the valve assembly 70, and the valve cover 80 integrally coupled to the block 40. Referring to the drawings, in a state where the cylinder 50 and the valve assembly 70 are placed between the valve cover 80 and the block 40 in order, the pressurized bolt 90 allows a bolt head to been gaged in the valve cover 80 and a bolt front end to be screw-fastened to the block 40, so that the engagement end 53 of the cylinder 50 is engaged in the supporting end 451 of the cylinder insertion hole 45 so that the cylinder 50 is pressurized to be coupled to the block 40.

As mentioned above, the pressurized bolt 90 is a feature for having the cylinder 50, the valve assembly 70, and the valve cover 80 integrally coupled to the block 40. Referring to the drawings, in a state where the cylinder 50 and the valve assembly 70 are placed between the valve cover 80 and the block 40 in order, the pressurized bolt 90 allows a bolt head to been gaged in the valve cover 80 and a bolt front end to be screw-fastened to the block 40, so that the engagement end 53 of the cylinder 50 is engaged in the supporting end 451 of the cylinder insertion hole 45 so that the cylinder 50 is pressurized to be coupled to the block 40.

The cylinder coupling structure of the compact air compressor explained in the above and illustrated in the drawings is merely an example and should not be interpreted to limit the technical idea of the present invention. The scope of protection of the present invention should be determined only by the matters recited in the following claims, and it should be interpreted that improvements and modified embodiments which do not deviate from the gist of the present invention fall within the scope of protection of the present invention.

The invention claimed is:

1. A compact air compressor, comprising:

a block (40) integrally formed with a suction muffler and a discharge muffler;

a tubular-shaped cylinder (50) coupled to the block (40), wherein the tubular-shaped cylinder is located between the suction muffler and the discharge muffler;

a valve assembly (70) provided with a suction valve and a discharge valve to block a front end of the tubular-shaped cylinder, the valve assembly comprising a valve plate (71) which blocks a front end opening of the tubular-shaped cylinder, wherein a discharge hole (713) is formed in the vale plate;

a valve cover (80) covering the valve assembly (70) so as to form a suction space and a discharge space at an upper portion of the valve assembly (70);

at least one pressurized bolt (90) coupling the valve cover (80) and the block (40) so as to pressurize the tubular-shaped cylinder (50) between the valve cover (80) and the block (40), wherein the valve assembly (70) and the valve cover (80) are coupled to the block (40) by the at least one pressurized bolt (90);

a piston (60) reciprocating inside the tubular-shaped cylinder (50);

a stator (21) coupled to the block (40); a rotator (25) located to rotate relatively with respect to the stator (21);

a crankshaft (30) coupled to the rotator to rotate integrally with the rotator (25) to be rotatable coaxially with the block (40);

a connecting rod (34), each of both ends thereof being connected to the crankshaft and the piston, respectively, so as to convert a rotational movement of the crankshaft into a straight reciprocating movement of the piston (60);

a discharge connection pipe (94) divided into a pit pipe (942) and a pit (941), and the pit pipe being insertedly coupled to the pit, the discharge connection pipe being connected to the valve cover (80) and guides the compressed air sucked into the valve cover, wherein the pit pipe is protrusively coupled to the discharge hole in a direction where the valve cover pressurizes the tubular-shaped cylinder, and the pit is connected to an inlet of the discharge muffler; and a compressed air staying space (S) inside the discharge muffler (44) connected to the discharge connection pipe (94).

2. The compact air compressor of claim 1, characterized in that a compressed air staying inlet (S1) of the compressed air staying space (S) is formed to be broader than an outlet (S2) of the compressed air staying space (S).

3. The compact air compressor of claim 1, characterized in that a staying recess part (S') is formed immediately below the compressed air staying space (S).

* * * * *